US009339071B2

(12) United States Patent
Herman

(10) Patent No.: US 9,339,071 B2
(45) **Date of Patent: *May 17, 2016**

(54) SHIRT-STAY SUSPENDERS

(71) Applicant: Sal Herman, Bloomfield Hills, MI (US)

(72) Inventor: Sal Herman, Bloomfield Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/577,867

(22) Filed: Dec. 19, 2014

(65) Prior Publication Data

US 2015/0101109 A1 Apr. 16, 2015

Related U.S. Application Data

(63) Continuation-in-part of application No. 14/029,228, filed on Sep. 17, 2013, which is a continuation of application No. 13/900,284, filed on May 22, 2013, now abandoned, which is a continuation-in-part of application No. 13/631,160, filed on Sep. 28, 2012, now Pat. No. 8,555,421, which is a continuation of application No. 13/198,469, filed on Aug. 4, 2011, now Pat. No. 8,832,866, which is a continuation-in-part of application No. 12/872,014, filed on Aug. 31, 2010, now Pat. No. 8,209,779.

(51) Int. Cl.

| | |
|---|---|
| ***A41F 3/00*** | (2006.01) |
| ***A41F 17/00*** | (2006.01) |
| ***A41F 3/02*** | (2006.01) |
| ***A41F 11/00*** | (2006.01) |
| ***A41F 13/00*** | (2006.01) |
| *A41F 3/04* | (2006.01) |

(52) U.S. Cl.

CPC . *A41F 17/00* (2013.01); *A41F 3/02* (2013.01); *A41F 11/00* (2013.01); *A41F 13/00* (2013.01); *A41F 3/04* (2013.01)

(58) Field of Classification Search

CPC ..... A41F 3/00; A41F 11/00; A41F 13/00; A41F 17/00

USPC ..... 2/306, 308, 311, 312, 313, 316, 321

See application file for complete search history.

(56) References Cited

U.S. PATENT DOCUMENTS

| | | | | | |
|---|---|---|---|---|---|
| 4,416,405 | A | * | 11/1983 | Caillouet | 224/257 |
| 4,481,682 | A | * | 11/1984 | Hall | 2/326 |
| 5,230,451 | A | * | 7/1993 | Onozawa | 224/194 |
| 5,437,402 | A | * | 8/1995 | Ring | 224/159 |
| D397,840 | S | * | 9/1998 | Slocum | D2/891 |
| 5,920,964 | A | * | 7/1999 | Malzahn | 24/182 |
| 2011/0197335 | A1 | * | 8/2011 | Handy | 2/117 |

* cited by examiner

*Primary Examiner* — Anna Kinsaul

(74) *Attorney, Agent, or Firm* — John A. Artzx; Dickinson Wright PLLC

(57) ABSTRACT

Suspender devices for maintaining in place a shirt or other upper garment for a wearer. The suspender devices having an elongated strap member with an upper end having fastener members thereon for attachment to a shirt or other upper garment, and with a lower end having a foot loop for being positioned around the wearer's foot or footwear.

3 Claims, 8 Drawing Sheets

SHIRT-STAY SUSPENDERS

CROSS-REFERENCE TO RELATED APPLICATIONS

This application is a continuation-in-part of U.S. patent application Ser. No. 14/029,228, filed on Sep. 17, 2013, which is a continuation of U.S. patent application Ser. No. 13/900,284, filed on May 22, 2013, which is a continuation-in-part of U.S. patent application Ser. No. 13/631,160 filed on Sep. 28, 2012, which is a continuation of U.S. patent application Ser. No. 13/198,469 filed on Aug. 4, 2011, which is a continuation-in-part of U.S. patent application Ser. No. 12/872,014, filed on Aug. 31, 2010, now U.S. Pat. No. 8,209,779.

TECHNICAL FIELD

The present invention relates to suspenders for securing shirts and other garments in position.

BACKGROUND

Suspenders have been used by persons for decades. Suspenders have been utilized to hold up pants (trousers, slacks, etc.), socks, and other items of clothing.

Suspenders can be used by persons as a fashion statement, by persons who have enlarged waist areas, or by persons who simply prefer not to wear belts (for comfort or otherwise). Typically pants suspenders have two straps that fit over the shoulders of the wearer and are attached at their free ends by buttons or clips to other clothing. The two straps can also be connected together at the back of the wearer, such that only a single strap continues from the connection spot to the waist area of the wearer's pants.

Other suspenders have been used to hold socks in place or, to connect shirts and other garments to socks. The suspenders can be connected with buttons and button holes or clips of different types.

There is a need for suspenders to keep a person's shirt or other upper garments in place without the use of a belt or other fasteners positioned around the person's waist. There also is a need for such suspenders where the person is exercising, riding a vehicle outdoors, subject to high winds, or wearing footwear, such as boots.

The present invention meets those needs.

SUMMARY OF THE INVENTION

The present invention relates to suspenders which are used to keep users' shirts and other upper garments in place regardless of weather conditions, the users' activities, or the users' footwear. A preferred embodiment of the invention includes a pair of suspender devices, each device including an elongated stretchable strap member, one or more fasteners at one (upper) end for attachment to a shirt or other upper garment, and an adjustable loop member at the other (lower) end for positioning under a foot or footwear.

A pair of short strap members with clip-type fasteners can be provided on the upper end of the strap member, preferably is a V-shape arrangement. A strap loop can be provided on the end of the strap member to assist in tightly securing the lower end to a foot or footwear. The strap member preferably has tiny loop members on one side, and the strap loop is freely adjustable by including a piece of material with mating small hook members. The hook-and-loop connection can be a Velcro®-type connection.

Further objects, features and benefits of the invention are set forth below in the following description of the invention when viewed in combination with the drawings and claims.

DESCRIPTION OF THE PREFERRED EMBODIMENTS

The present invention relates to suspenders, especially with clip-type fasteners, that are used primarily for attaching suspenders to pants and keeping upper garments in place. The shirts and other garments are held in place regardless of the user's activities, weather conditions, or the user's footwear. It is to be understood that the suspenders disclosed herein are not to be limited solely for these uses, but can be used for many other purposes. For purposes of illustrating and discussing the invention, the invention will be disclosed with the preferred use of maintaining shirts in place by attachment of the suspenders to the foot or footwear of the user.

In this regard, the term "shirt" is used as a generic term and includes t-shirts, formal shirts, golf shirts and the like worn by wearers and typically covering a portion of the upper half, or a portion thereof, of the wearer's body. Also, the term "clip-like" is used as a generic term to mean any fastener that has two or more components or parts that fit over a shirt garment or the like and are "snapped" or otherwise held together in a manner that securely holds the fastener onto the shirt garment or other material.

Figure 1:
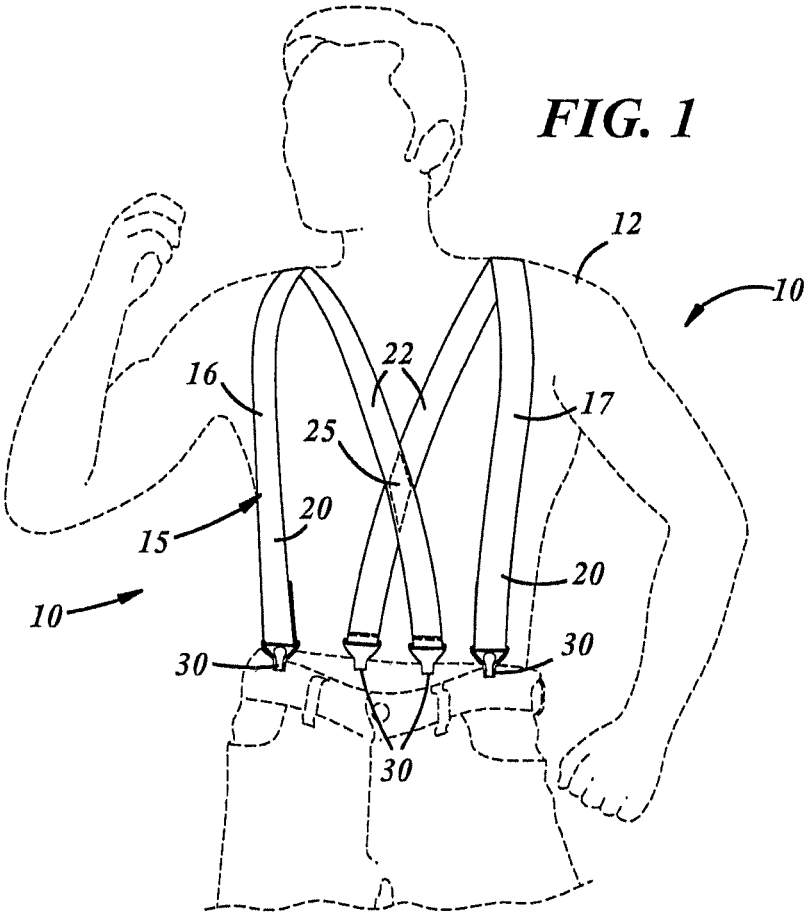
FIG. 1 schematically depicts typical suspender devices as worn by a wearer.

The use of a related invention is shown in FIG. 1 and referred to by the numeral 10. The person 12 (or "wearer") is wearing a set of suspenders 15. The suspenders 15 depicted in FIG. 1 are only one of many types and sets of suspenders which could be worn by a person.

In FIG. 1, the suspenders 15 have two straps 16 and 17, each of which has a portion 20 positioned on the front of the wearer and a portion 22 positioned on the back of the wearer. The two straps are also connected on the back—which is typical with many suspenders—at 25. The connection 25 could be made in any manner, such as by sewing.

The free ends of each of the strap members have a clip-type fastener 30 thereon. The fasteners 30 are typically the same for all the ends of the straps, but they could be different types of fasteners if desired at different ends.

In FIG. 1, four fasteners 30 are shown. It is clear with many types of suspenders that only two or three fasteners are utilized. For example, suspenders which are attached at the sides or hips of the wearer typically only utilize two fasteners. Also, in some sets of suspenders, only a single strap member is utilized at the back of the wearer positioned between connection 25 and the waist of the pants. These suspenders only utilize three fastener members.

Figure 2:
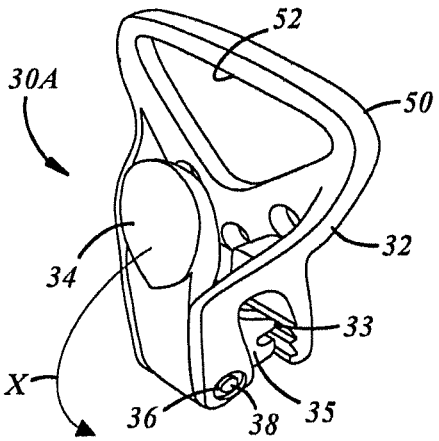
FIGS. 2 and 3 depict an embodiment of the invention.
Figure 3:
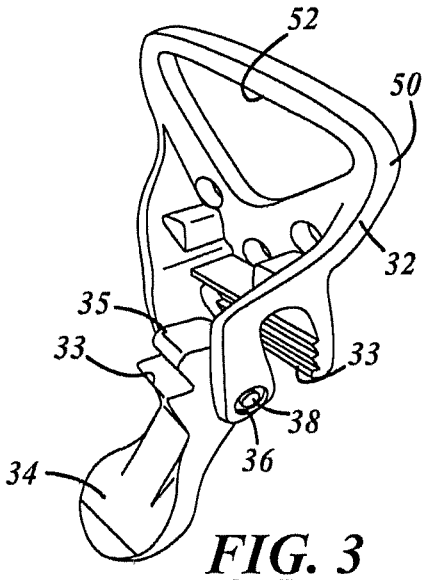

Two representative embodiments of clip-type fasteners are shown in FIGS. 2-3 and FIGS. 5-6, respectively. In FIGS. 2-3, the fastener 30A is an over-center clip-type fastener with a base member 32 and a hinged or pivoted lever member 34. The lever member is pivoted to the base member by pivot pin member 36 which extends through openings 38 in the two side flange members of the base member 32 and through opening or channel member in lever member 34.

When actuated to grip a garment in the direction shown by arrow "X", the locking portion 35 meshes with mating locking portions 33 on base portion 32 which tightly grips and holds the garment between the two locking portions. The rotation of the lever member around the pivot pin 36 provides a cam action which tightly locks the garment in place.

Fastener 30A also includes a slotted flange member 50. This facilitates connecting the end of the suspender strap to the fastener. The end of the strap can be passed through the slot 52 in the ring member and then be attached back to itself, such as sewing, or with an adjustment mechanism, such as Velcro® hook-and-loop type material. This is shown, for example, in FIG. 9.

Preferably, all of the components for the fastener 30A are made from a non-metallic material. This includes the base member 32, the lever member 34 and the pivot pin member 36. A preferred material for each of the components is a plastic material such as hard plastic. Other preferred materials include graphite and composition materials, such as glass filled nylon.

Figure 5:
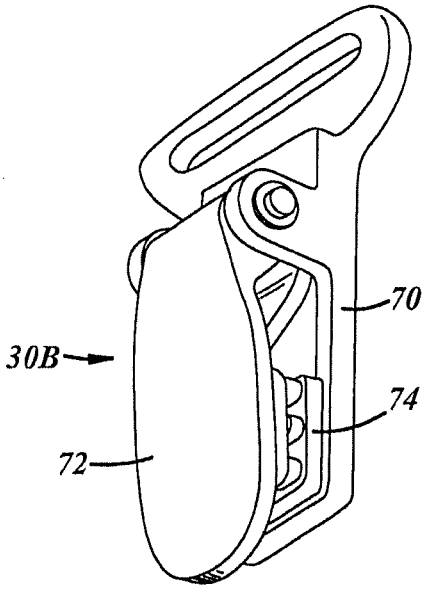
FIGS. 5 and 6 depict still another embodiment of the invention.
Figure 6:
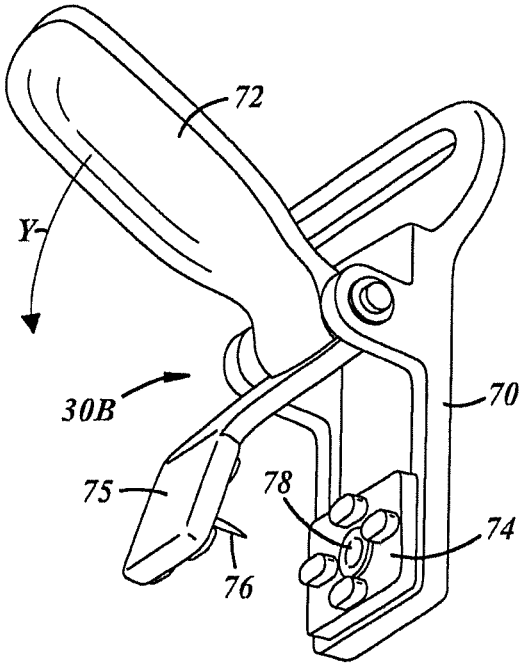

The various clip components can be made from different materials, although the use of hard plastic materials are preferred, particularly for the pivot pin member 36 and the plunging pin member 76. Preferably, the gripping member 74 disclosed in FIGS. 5 and 6, is made from a softer plastic material that can grip and hold the plunging pin member 76 once it is inserted through a fabric material and the end of the pin member is inserted in the hole in the gripping member. The gripping member 74 can also be made of a hard elastomeric material in order to firmly hold the plunging pin member in place and hold the clip-type fastener in its closed position.

The precise size and shape of the clip-type fastener 30A and its components are not critical so long as one component (e.g., a lever member) has an over-center or cam action in order to be locked in place with the other component (e.g. a base member).

The pivot pin member 36 can be assembled in place holding together the other two component members 32 and 34 in any desired manner, such as by a force-fit procedure. In an alternate embodiment, tiny bearing members (not shown), such as small cylinders or rings made of silicon or a similar material can be positioned in the openings 38.

Figure 4:
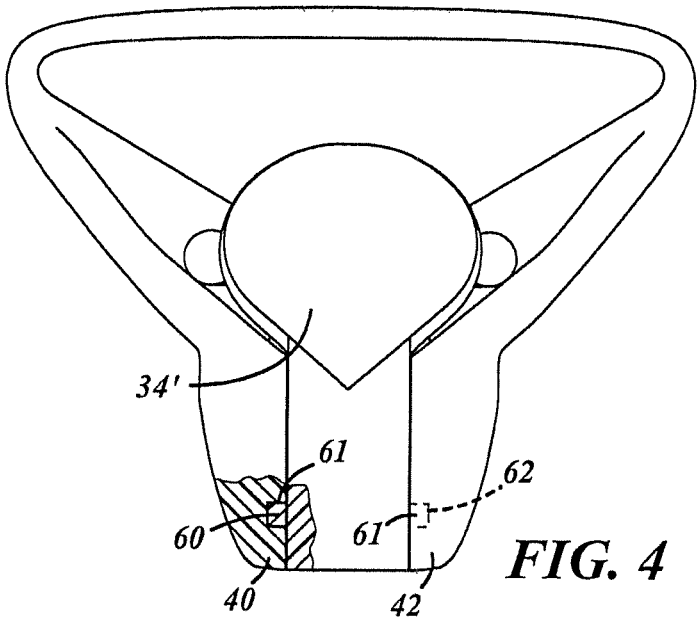
FIG. 4 depicts another embodiment of the invention.

In another embodiment as shown in FIG. 4, the lever member 34' can be formed with a pair of post members 60 and 62. This eliminates one long pin member such as 36 in FIGS. 2 and 3. During assembly, the post members 60 and 62 are positioned in the openings 61 in the side flange members 40 and 42 in the base member. The lever member 34' is actuated in the same manner as lever member 34 discussed above as the two post members rotate (or pivot) in the openings 61.

The length of the post members 60 and 62 is dependent on the resiliency of the side flange members 40 and 42 which have to be forced away from each other in order to assemble the lever member 34' in place and allow the post members 60 and 62 to fit in the openings 61.

In the embodiment shown in FIGS. 5 and 6, the clip-type fastener 30B has a greater number of components than the embodiment shown in FIGS. 3 and 4. It includes a base member 70, a lever member 72, a gripping member 74 with a plunging pin member 76 and a pin reception member 78 on the base member. The lever member 72 has a flange member 75 on which the gripper member 74 is positioned. The lever member 72 causes the flange member 75 to rotate toward the base member. As the lever member rotates as indicated by arrow "Y", the lever member forces the flange member 75 towards the base member 70. This plunges the pin member 76 through the fabric or garment placed over the base portion and into the pin reception member 78. This action is similar to the over-center cam action of the lever member as shown in FIGS. 3 and 4 and discussed above.

When the lever member is forced to its closed position as shown in FIG. 5, the pin member is seated in the reception member and any garment positioned between them is securely held in place.

Similar to the embodiment discussed above, all of the components of the clip-type fastener 30B are preferably made from a non-metallic material.

Figure 7:
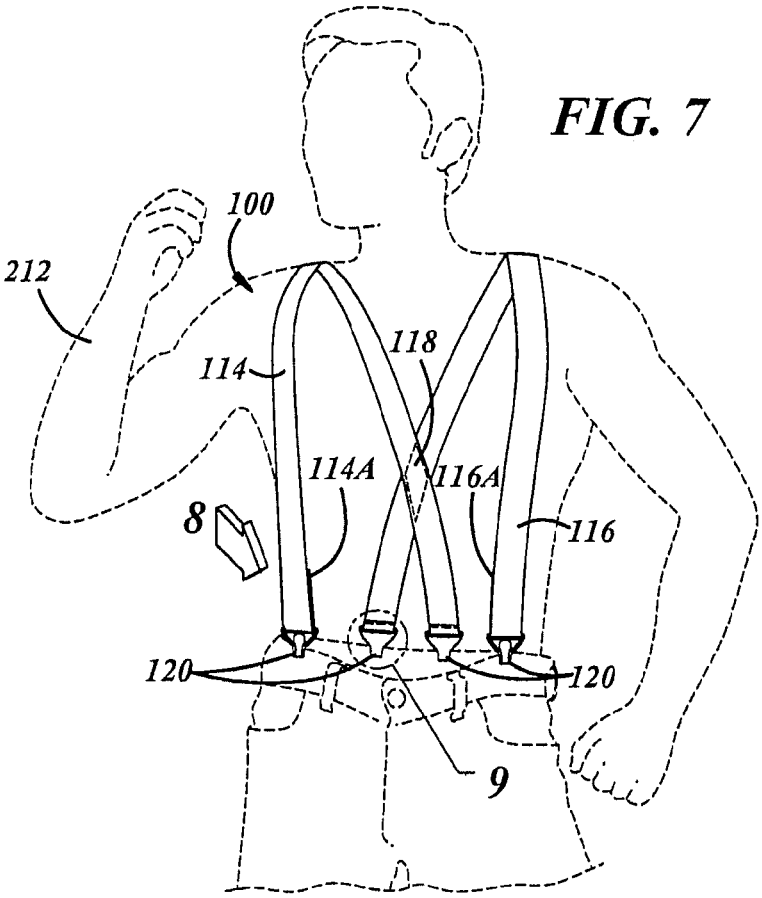
FIGS. 7-13 illustrate another embodiment of the invention.
Figure 8:
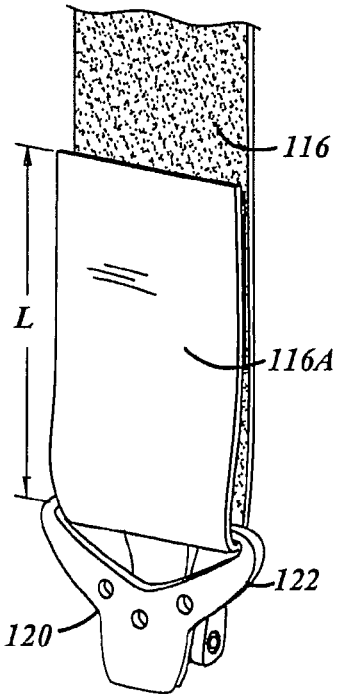

As shown in FIGS. 7 and 8, each of the strap members have a sufficient length to extend from the waistline at the rear of the wearer to the waistline at the front of the wearer. Each of the straps also has an additional amount which is used to adjust the suspenders for different sizes and shapes of wearers. These additional amounts are indicated by the reference numerals 114A and 116A in the drawings, as well as by "L" in FIG. 8.

The strap members 114 and 116 are attached together at 118 where they overlap in the back of the wearer 100. They can be connected together by any mechanism or method which attaches them together, such as by being glued or sewn together, or with releasable Velcro® hook and loop-type fasteners.

Fastener members 120 are used to connect the strap members to the pants or trousers worn by the wearer. The fasteners 120 are non-metallic clip-type fastener members, such as those described above with reference to FIG. 2-3, 4 or 5-6.

As to the portion of the suspenders which are to be positioned at the back of the wearer, the fastener members 120 can be securely affixed to the ends of the strap members. This is shown, for example, in FIG. 9 where the end 116B of the strap member 116 is positioned through the ring member 122 and securely attached, such as by stitches 124 made by sewing, on the strap member. Preferably, both of the "rear" or "back" ends of the strap members 114 and 116 are connected to their respective fastener members in the same way.

Figure 9:
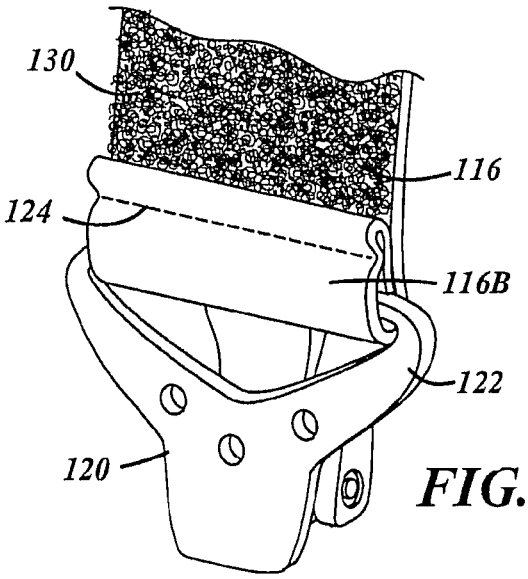
Figure 12:
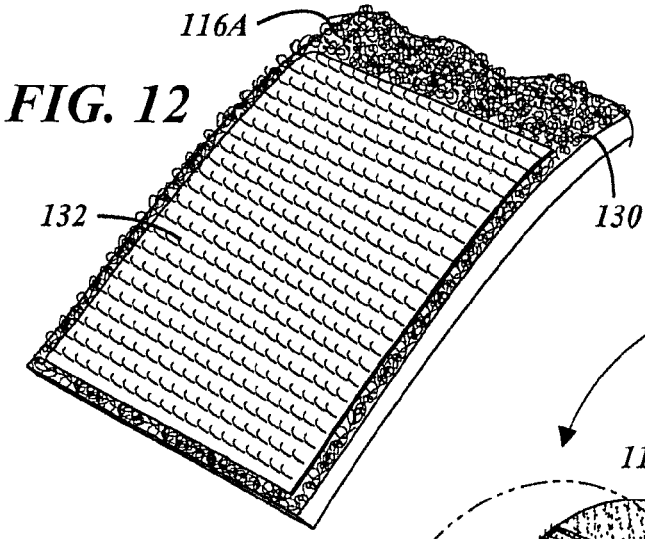
Figure 10:
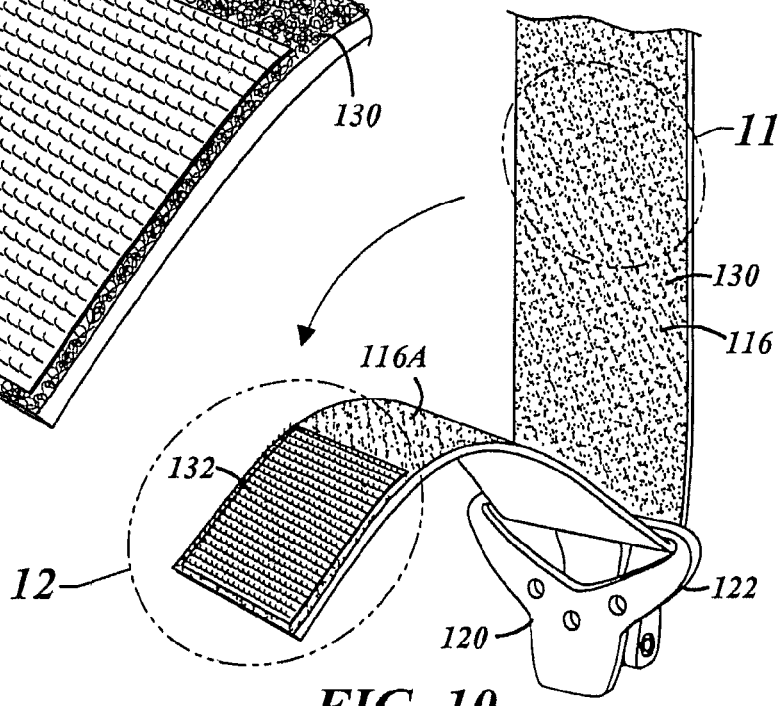
Figure 11:
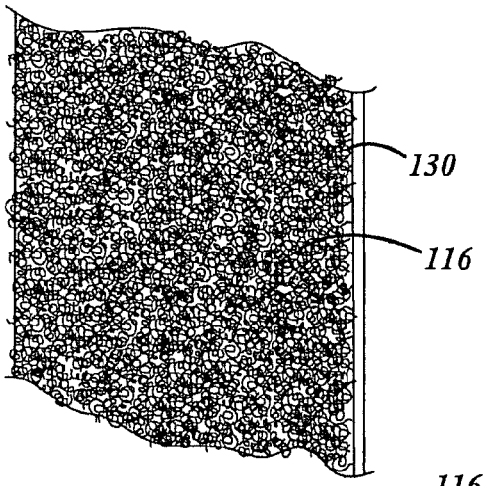
Figure 13:
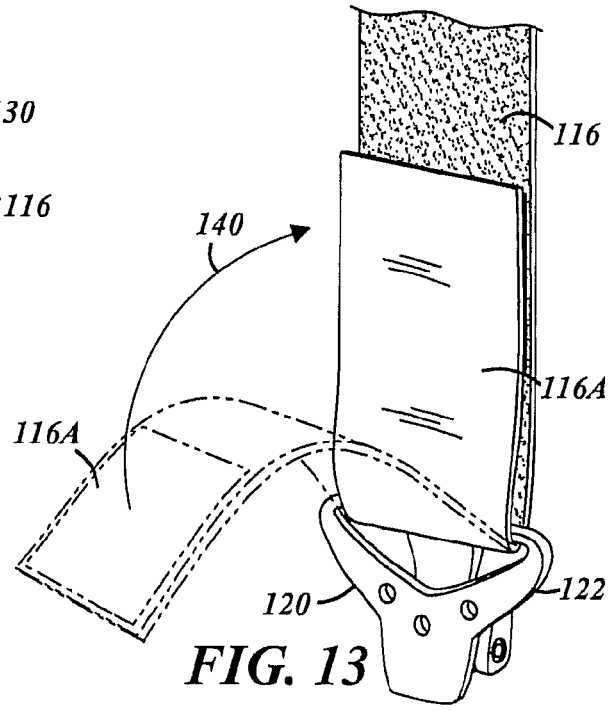

The portion 116A of the strap member 116 is adapted to be secured at any position along the strap member that the wearer desires. This makes the suspenders essentially infinitely adjustable. For this purpose, the strap members are made of a material with a plurality of small loop members 130 on at least one surface. This is shown in FIGS. 9-11. Additionally, a piece of Velcro®-type hook material 132 is glued, sewn or otherwise securely affixed to the end portion 116A of the strap member 116 as shown in FIGS. 10, 12 and 13. The piece of material 132 has a plurality of small hook members extending therefrom.

When the strap portion 116A is passed through the ring member 122 and pressed up against another portion of the strap member 116, some of the tiny hook members on material 132 mate with some of the tiny loop members 130 and secure the two items together. This movement is shown by arrow 140 in FIG. 13.

Although any type of material with hook members thereon can be used as material 132, preferably the material is one-half of a Velcro®-type fastening system.

Since the loop members 130 are present all along one of the surfaces of the strap members 114 and 116, the suspenders in accordance with the present invention are infinitely adjustable. This allows the suspenders to be easily adjusted to fit any body size or shape. It also allows a wearer to quickly and easily adjust the suspenders at any time for any reason, such as to make them more comfortable on certain days. This also allows the wearer to be able to unfasten the suspenders without undoing the front fasteners.

Although the above description relates specifically to strap member 116, it is to be understood that the same structure and members are to be used for strap member 114 and any other strap members in any other suspender configuration incorporating the present invention.

Preferably, the loop members 130 are provided only on one side of the strap members and this is the side which is worn adjacent the body of the person. (This also is what is shown in the drawings.) The other side of the strap members, that is the outer side, preferably has a smoother and harder surface. This allows outer garments to side easily over the strap members without catching or sticking. Of course, it is also possible that the strap members can have the same loop-type surfaces on both sides, or the suspenders could be worn with the loop side out.

The material used for the strap members 114 and 116 preferably are stretchable or made from an elastic material. This would provide additional comfort and adjustability to the wearer.

Figure 16:
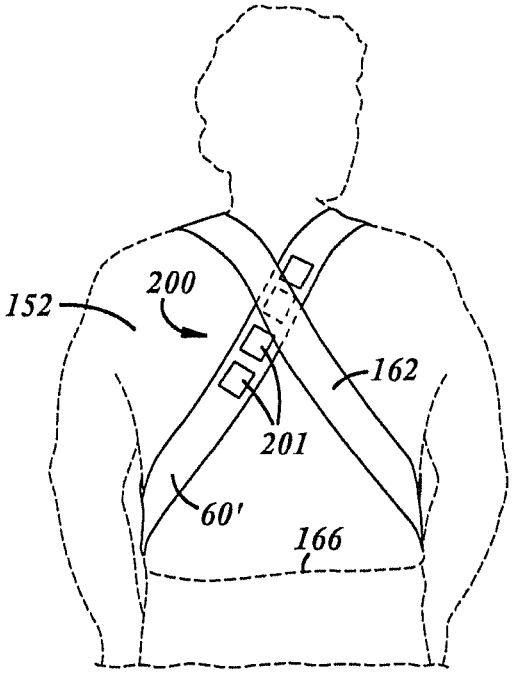
Figure 17:
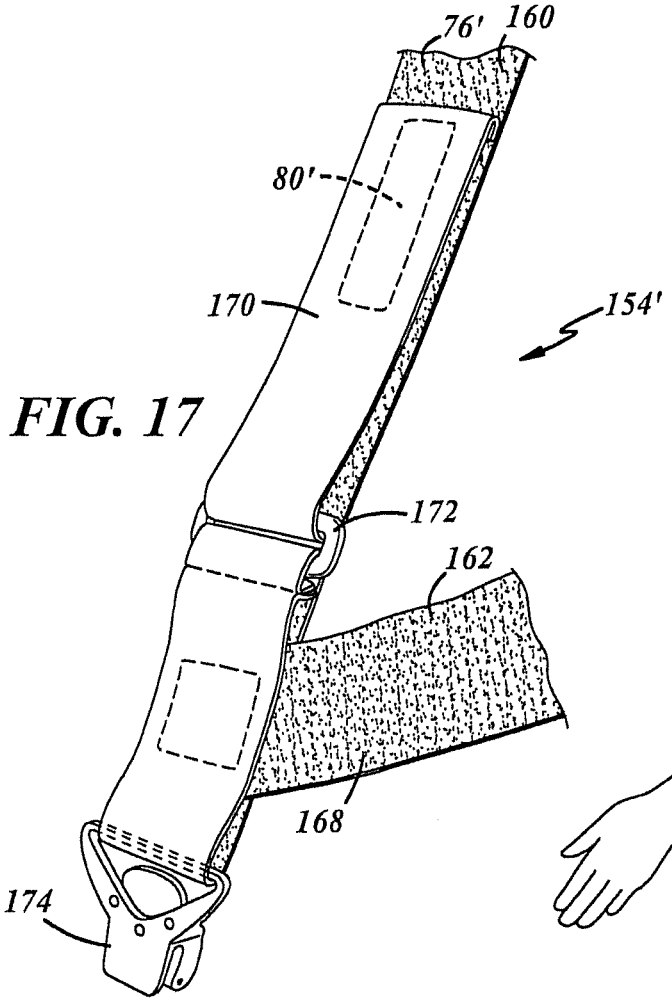
Figure 18:
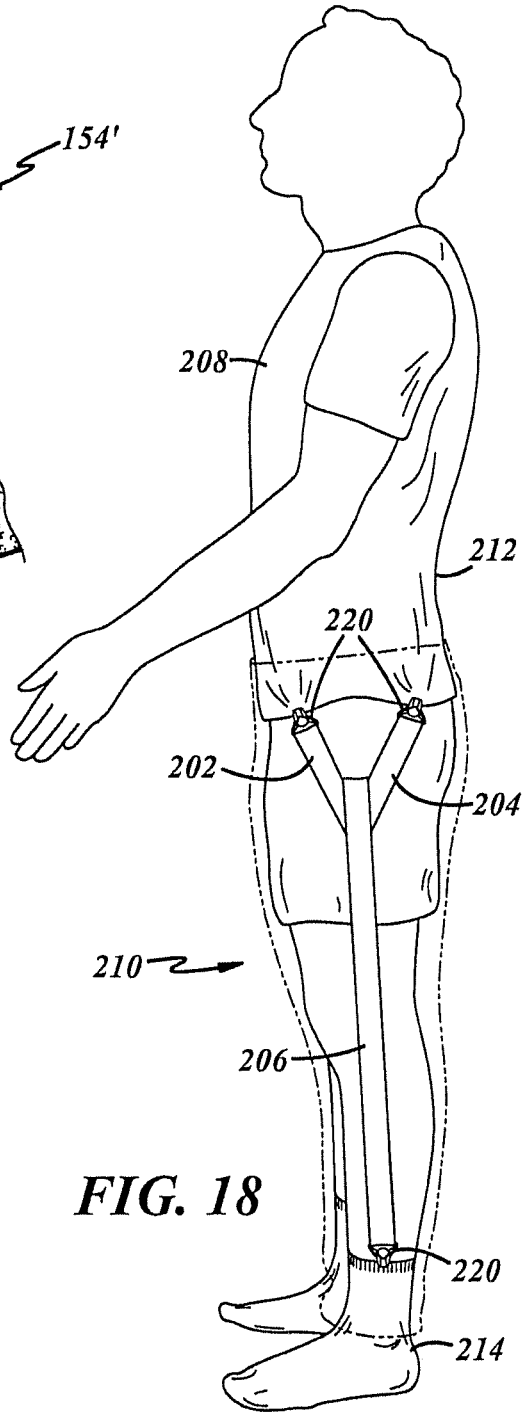
FIGS. 18-20 illustrate a further embodiment of the invention.
Figure 19:
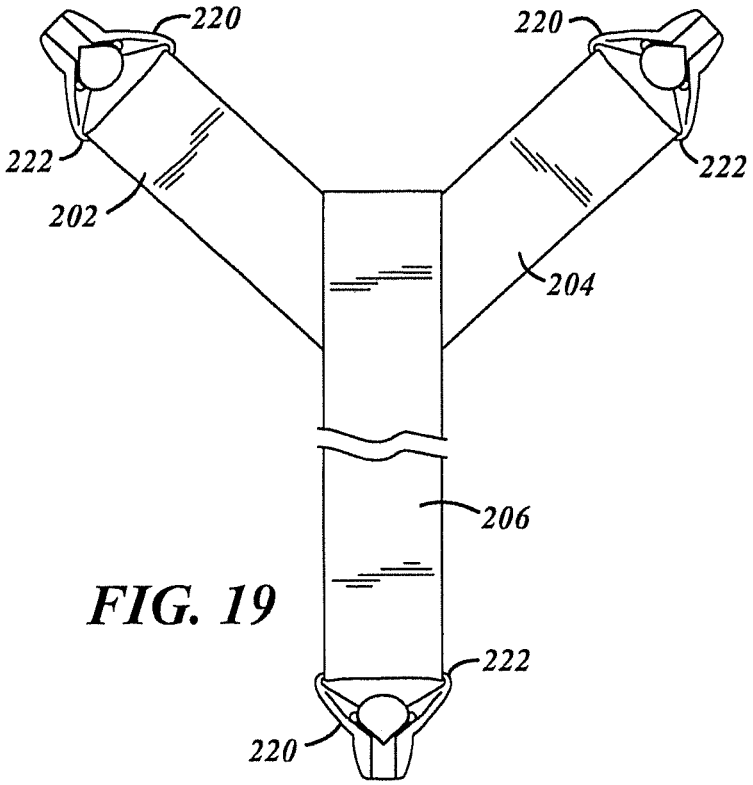
Figure 20:
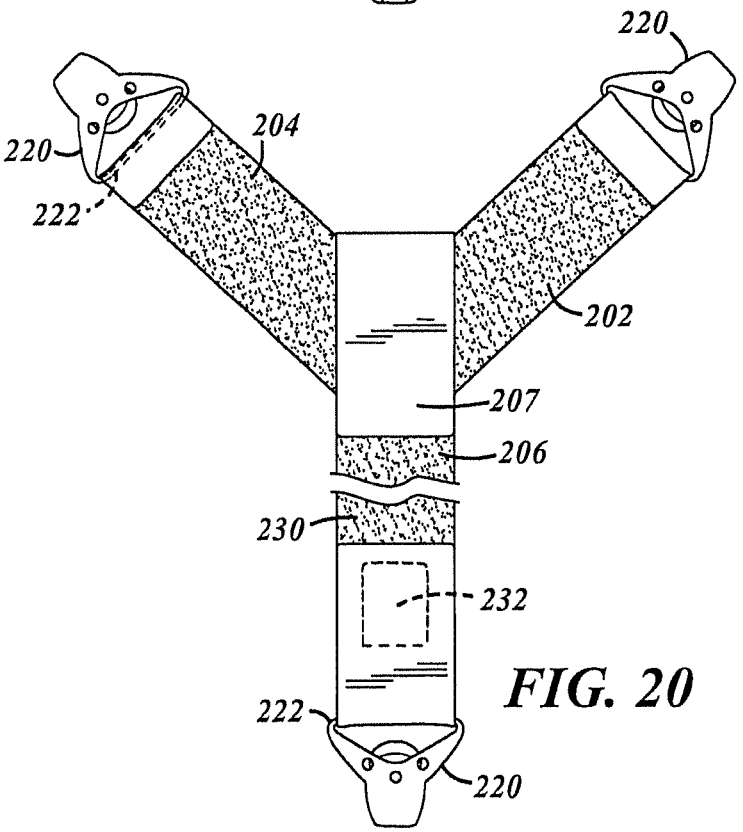

Other embodiments of the invention are shown in FIGS. 14-17 and in FIGS. 18-20. In all of these embodiments, the strap material, fasteners and adjustment system are preferably the same as, or similar to, those set forth above. FIGS. 14-17 depict an embodiment of the invention known as "hip-style" suspenders. Suspenders of this type are called "Hip-Clip Suspenders" and sold by Hold-Up Suspender Company in Southfield, Mich.

Figure 14:
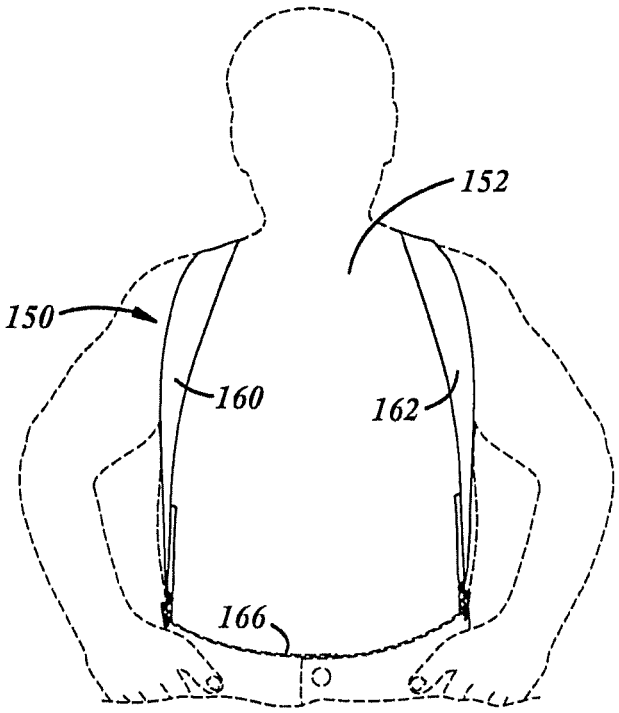
FIGS. 14-17 illustrate still another embodiment of the invention.
Figure 15:
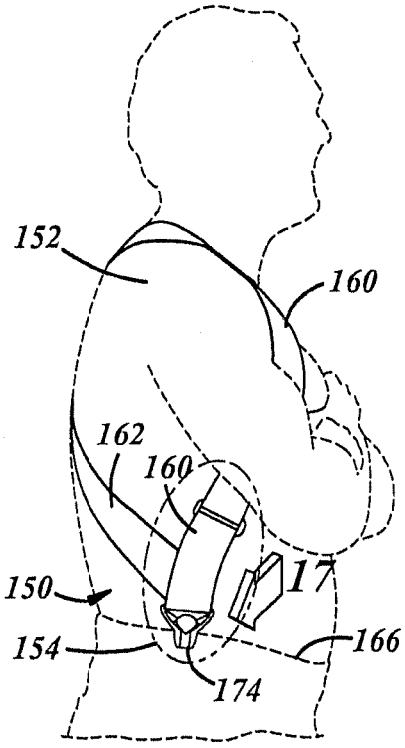

FIG. 14 depicts the front view of one such embodiment 150 as worn by a person 152, while FIG. 15 is a side view and FIG. 16 is a back view. FIG. 17 is an enlarged view of a portion 154 of the figure shown in FIG. 15. As indicated, only two fasteners are needed in "hip-style" suspenders with the fasteners positioned and adapted to be connected to the waistband 166 of the wearer's pants at the hips of the wearer.

The suspenders 150 have a pair of strap members 160 and 162. The strap members are attached together where they cross-over each other on the back or rear of the wearer. The strap members can be connected at that area in any way, such as by sewing or gluing, or by releasable Velcro®-type hook and loop fasteners. The latter attachment system is shown in FIG. 16 and referred to by the reference numeral 200. One or more pieces 201 of hook-type material are secured to one of the straps.

The strap members 160 and 162 are also attached to each other at a position on the sides of the wearer and adjacent the waistband 166 of the wearer's pants or trousers. This is shown for one side in FIG. 15. The attachment mechanism on the other side of the wearer is the same. As shown in FIG. 17, the end 168 of strap member 162 is securely attached to strap member 160, while the end portion 170 of strap member 160 is passed through slot 172 of fastener 174 and releasably attached to itself. This is the adjustment system or mechanism for the suspenders and is substantially the same as the adjustment mechanism for the sets of suspenders described above.

As with the suspender embodiments disclosed above, one surface of each of the strap members has a plurality of small loop members positioned substantially along the entire length of the strap member. A piece of hook-type Velcro material 180 is secured to the end portion 170 of the strap member in order to mate with and be releasably fastened to the loop members.

The opposite sides of the strap members preferably have a hard or smooth surface, but also could have loop members thereon. Each of the strap members could also be made of a stretchable material, such as an elastic material.

The hip-style suspenders provide a more comfortable style of suspenders to some wearers than the more common "two-strap" pant suspenders. Also, since the hip-style suspenders are designed to be worn under an outer shirt of the wearer, the hip-style suspenders provide for slightly easier removal for restroom visits.

Embodiments of a shirt-and-sock type suspender 210 are shown in FIGS. 18-20. A preferred embodiment has a "Y"-type shape with two arm-type strap members adapted to be fastened to the wear's shirt and an elongated strap member adapted to be fastened to the wearer's sock. A pair of shirt-and-sock type suspenders are worn by the wearer in order to keep both socks tight and prevent them from falling, and at the same time keeping both sides of the wearer's shirt neat and inside the wearer's pants.

The embodiment shown in FIGS. 18-20 has three strap members 202, 204 and 206 secured together at the "V" of the "Y"-shaped suspender. The strap members all preferably are made of an elastic or stretchable-type material with a plurality of loop members on one side. The outer ends of each of the three strap members have fasteners 220 attached thereon for securely holding in place either a skirt or a sock. At least the outer end of the elongated strap member has a hook-type Velcro® material attached thereto and is adjustable. The outer ends of the two arm-type strap members are preferably fixedly secured to their fastener members, but they also can have hook-type materials attached to them so they also can be adjustable.

As shown in the embodiment illustrated in FIG. 18-20, the suspender 210 has a pair of arm-type strap members 202 and 204 attached to an elongated strap member 206. The three strap members are secured together in a "Y"-shaped configuration and are adapted to be worn by a wearer 208 in the manner shown in FIG. 18. The length of the suspender 210 is sufficient to extend from about the waist of the wear to the lower calf or ankle of the wearer in order to be attached at the upper end to the wearer's shirt 212 and at the other end to the wearer's sock 214. With a pair of suspenders 210, the wearer can maintain his shirt looking neat and always tucked in his/her pants, and at the same time, keep his/her socks tight and prevent them from falling.

In this regard, it should be understood that the invention is not to be limited to suspenders having the precise structure and configuration as shown in the drawings. The invention can be utilized with other sizes, shapes and strap configurations of suspenders which fulfill the same objective and purpose.

Fastener members 220 are used to connect the strap members to the shirt or socks worn by the wearer. Preferably, the fasteners 220 are the same as the non-metallic plastic clip-type fastener members 30 as discussed above.

Preferably, the three fastener members 220 on each suspender 210 are the same, but each could also be different from one another. As shown, each fastener has a slot 222 which allows the strap members to slide through them.

The end portion 207 of the elongated strap member 206 is adapted to be secured at any position along the strap member that the wearer desires. This makes the suspender 210 infinitely adjustable to fit and extend between the wearer's shirt and socks. The strap member 206 preferably is made of a material with a plurality of small loop members on at least one surface as discussed above. Additionally, a piece of Velcro®-type hook material 232 is glued, sewn or otherwise securely affixed to the end portion 207 of the strap member 106. The piece of material 232 has a plurality of small hook members extending therefrom in order to be detachably fastened to loop members on the strap.

When the strap portion 207 is passed through the ring member 222 and pressed up against another portion of the strap member 206, some of the hook members on material 232 mate with some of the loop members 230 and secure the two items together. This is the same as the pant-type suspenders described above.

Although any type of material with hook members thereon can be used as material 232, preferably the material is one-half of a Velcro®-type fastening system.

Since the loop members 230 are present all along one of the surfaces of the strap 206, the suspender is infinitely adjustable. This allows the suspenders to be easily adjusted to fit any body size or shape. It also allows a wearer to quickly and easily adjust the suspenders at any time for any reason, such as to make them more comfortable on certain days.

Although the above description relates specifically to strap member 206, it is to be understood that the same structure and members can be used for strap members 202 and 204 and any other strap members in any other suspender configuration in accordance with one embodiment of the invention. The end portions of the strap members 202 and 204 are fixedly secured to the fasteners 220, in the manner shown in FIG. 20 and described above with respect to FIG. 9.

The material used for the strap members 202, 204 and 206 also preferably is stretchable or elastic. This provides additional comfort and adjustability to the wearer.

With the present invention, metallic or plastic buckles that are in use today in many suspenders for adjustment of the straps on the wearers are eliminated. This eliminates the possibility of unsightly bumps or bulges under the outer garment, whether it be a shirt or a pair of form-fitting pants. By having the fasteners made only of non-metallic components, the suspenders then can be worn during medical procedures and through security scanners, such as airports.

Figure 21:
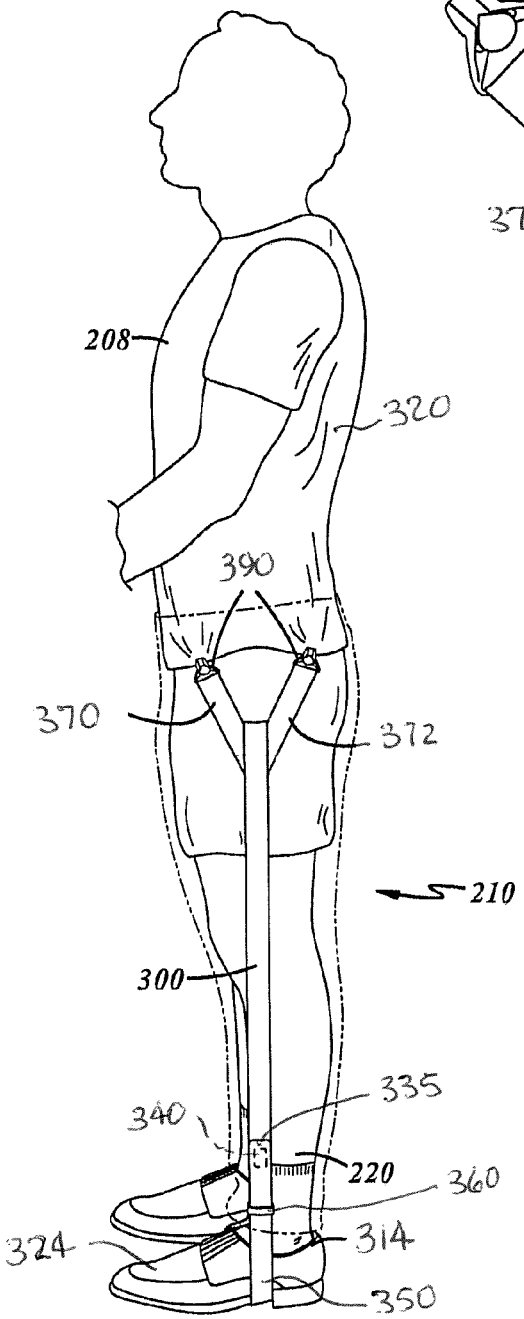
FIGS. 21-23 illustrate an additional embodiment of the invention.
Figure 22:
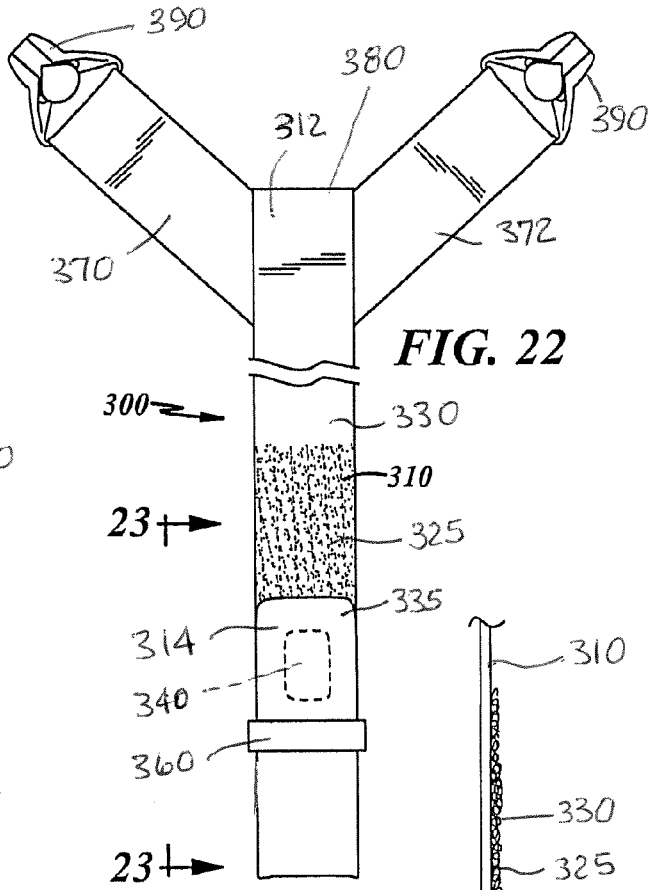
Figure 23:
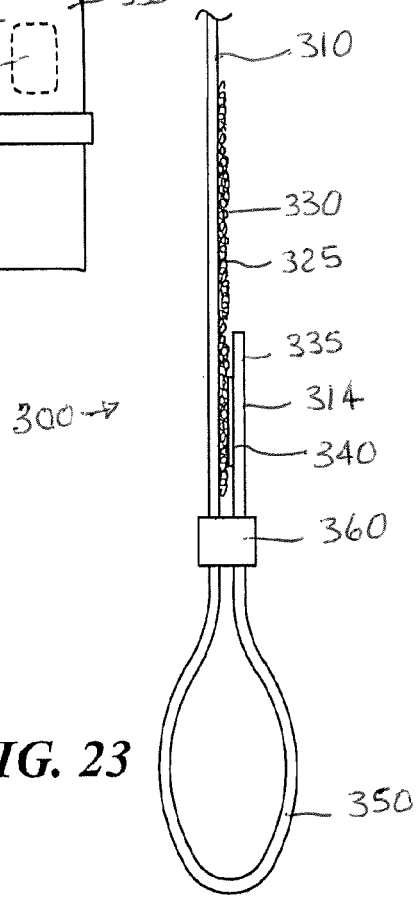

Another preferred embodiment of the invention is illustrated in FIGS. 21-23. The embodiment is referred to generally by the reference numeral 300. FIG. 21 depicts use of a suspender device 300 being worn by a user, while FIG. 22 depicts one of the devices 300 in a plan view, and FIG. 23 is an enlarged side view of the lower portion of the device 300.

As indicated in FIGS. 21-23, the suspender device 300 includes an elongated strap member 310 having an upper end 312 and a lower end 314. The upper end is adapted to be attached to the shirt or other upper garment 320 worn by a person. The upper end is preferably attached to the bottom edge or "shirt tail" of the garment as shown in FIG. 21.

The lower end 314 is adapted to be connected to or otherwise positioned on the foot or shoe 324 of the wearer. The lower end 314 can be positioned under the arch or foot of the wearer inside or outside of a shoe or other footwear worn by the wearer. The invention has particular use if the wearer is actively engaged outside, such as riding a bike or motorcycle and is wearing boots and wants his shirt or other upper garment to stay in position while the bike or motorcycle is moving.

One side or surface 330 of the elongated strap member 310 has a plurality of small (tiny) loop members along 325 the entire side or surface. The small loop members are the same as the small loop members with respect to the suspender embodiments discussed and described above. The loop members preferably are one-half of the mating connecting mechanism of Velcro® hook-and-loop fasteners.

Attached to end 335 of the elongated strap member 310 is a piece of Velcro®-type hook material 340. The piece of material 340 is glued, sewn, or otherwise securely affixed to the strap member 310. In this manner, the effective length of the suspender device 300 in use can be adjusted to any desired length.

As shown particularly in FIG. 23, the elongated strap member 310 is folded back on itself at the lower end 314. This forms a foot loop member 350 in which the foot, shoe, boot or other footwear of the user can be positioned.

After the foot loop member 350 is formed and the user's foot or footwear is positioned in it, the end 335 of the elongated strap member can be pulled making the loop tight or snug around the foot or footwear. Once the proper length is determined, the piece of hook-type material 340 can be forced against the surface of the elongated strap member with the small loop members thereon, and thereby releasably connect or fasten them together.

Prior to adjusting the loop member 350 in the lower end 314 of the suspender device 300 as stated above, it might be preferable alternatively to fasten the upper end 312 to the user's shirt or upper garment. The user has the option to affix either end first. Optionally, the suspender device 300 can be positioned and affixed in place with the user in a vertical position. The resiliency of the elastic material used for the elongated strap member can compensate for movements of the wearer.

In order to hold the two pieces of material together at the lower end 314 of the suspender device 300, a separate loop member 360 is provided. The loop member 360 is a continuous piece of material formed into a loop shape and positioned in the general area on the elongated strap member 310 as shown in FIG. 23. The strap loop 360 can be secured to either of the two pieces of strap material at the location shown in the drawings, or it can be unattached and allowed to be positioned at different locations as desired by the user.

The upper end 312 of the suspender device 300 is preferably the same as the corresponding upper end of the shirt-and-sock-type suspenders 210 discussed above and shown in FIGS. 18-20. The preferred embodiment has a "Y" shape with two arm-type short strip members 370 and 372 adapted to be fastened to the wearer's shirt or upper garment 320.

The strap members 370, 372 are secured together, preferably as shown in FIGS. 19 and 20. The upper end 380 of the elongated strap member 310 is securely fixed to the strap members 370, 372, in any conventional manner, such as by sewing or gluing. The strap members 370, 372 also preferably are made of a stretchable elastic material, like the elongated strap member 310. They also can have small loop members or hook members on one side in order to aid in attaching them to the end 380 of the elongated strap member 310.

Typically, a pair of suspender devices 300 are utilized by a wearer, one on each side of the wearer's body. In this manner, the wearer can maintain the shirt tucked in and looking neat and trim under all conditions.

Fastener members 390 are attached to the ends of the small strap members 370, 372. Preferably, the fastener members are the same as the fastener members shown in the other Figures (preferably FIGS. 2-3) and described above. Preferably the fastener members are clip-type fastener members that are connected to a garment in an over-the-center type fastening procedure.

Although the invention has been described with respect to preferred embodiments, it is to be also understood that it is not to be so limited since changes and modifications can be made therein which are within the full scope of this invention as detailed by the following claims.

What is claimed is:

1. A wearable suspender device configured and adapted for attachment between the lower edge of an adult wearer's upper garment and a foot of the wearer, the wearable suspender device comprising:

a first elongated strap member having an upper end, a lower end and a first surface and a second surface;

said first elongated strap member having a length sufficient to extend from the waist area of the wearer to the bottom of the wearer's feet;

a second V-shaped strap member positioned at said upper end of said first elongated strap member; said V-shaped strap member having two ends and a central portion;

said first surface of said first elongated strap member having a plurality of small loop members extending over said first surface, said loop members being loops of a hook-and-loop type fastener material;

a hook member secured adjacent the lower end of said first surface; said hook member having a plurality of small hook members thereon, said hook member comprising a piece of material with a plurality of small hook members thereon, said hook members being small hooks of a hook-and-loop type fastener material;

fastener members attached to each of said ends of said V-shaped strap member for attachment to the lower edge of the wearer's upper garment;

wherein said lower end of said first elongated strap member forms a first loop for positioning on a foot of the wearer;

wherein said hook member on said elongated strap member is selectively secured to said small loop members at any position along said first surface; and a second loop member positioned on said first elongated strap member adjacent said lower end; wherein said second loop member assists in securing said first loop for positioning on a foot of the wearer.

2. The suspenders as described in claim 1 wherein said fastener members are clip-type fastener members.

3. A wearable suspender device configured and adapted for attachment between the lower edge of an adult wearer's upper garment and the wearer's foot or footwear, said wearable suspender device comprising a pair of separate suspender members, each separate suspender member comprising:

a first elongated strap member having an upper end, a lower end and a first surface and a second surface;

said first elongated strap member having a length sufficient to extend from the waist area of the wearer to the bottom of the wearer's feet;

a second V-shaped strap member positioned at said upper end of said first elongated strap member; said V-shaped strap member having two ends and a central portion said first surface of said first elongated strap member having a plurality of small loop members extending over said first surface, said loop members being loops of a hook-and-loop type fastener material;

a hook member secured adjacent the lower end of said first surface; said hook member having a plurality of small hook members thereon, said hook member comprising a piece of material with a plurality of small hook members thereon, said hook members being small hooks of a hook-and-loop type fastener material;

fastener members attached to each of said ends of said V-shaped strap member for attachment to the lower edge of the wearer's upper garment;

wherein said lower end of said first elongated strap member forms a first loop for positioning on a foot of the wearer;

wherein said hook member on said elongated strap member is selectively secured to said small loop members at any position along said first surface; and a second loop member positioned on said first elongated strap member adjacent said lower end; wherein said second loop member assists in securing said first loop for positioning on a foot of the wearer.

* * * * *